US008002079B2

(12) United States Patent
Funahashi

(10) Patent No.: US 8,002,079 B2
(45) Date of Patent: Aug. 23, 2011

(54) DIAPHRAGM FOR SPEAKER, SPEAKER USING THE DIAPHRAGM FOR SPEAKER, AND PROCESS FOR PRODUCING THE DIAPHRAGM FOR SPEAKER

(75) Inventor: Osamu Funahashi, Mie (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/668,740

(22) PCT Filed: Jul. 10, 2008

(86) PCT No.: PCT/JP2008/001851

§ 371 (c)(1),
(2), (4) Date: Jan. 12, 2010

(87) PCT Pub. No.: WO2009/008173

PCT Pub. Date: Jan. 15, 2009

(65) Prior Publication Data

US 2010/0206659 A1 Aug. 19, 2010

(30) Foreign Application Priority Data

Jul. 12, 2007 (JP) ..... 2007-182917
Jul. 18, 2007 (JP) ..... 2007-186625
Jul. 18, 2007 (JP) ..... 2007-186626

(51) Int. Cl.

| | |
|---|---|
| ***G10K 13/00*** | (2006.01) |
| ***H04R 7/02*** | (2006.01) |
| ***H04R 7/06*** | (2006.01) |
| ***H04R 7/10*** | (2006.01) |
| *H04R 7/00* | (2006.01) |
| *H04R 1/22* | (2006.01) |

(52) U.S. Cl. ..... 181/169; 181/170; 381/426; 381/428

(58) Field of Classification Search ..... 181/169, 181/170, 167; 381/423, 426, 428; 156/245
See application file for complete search history.

(56) References Cited

U.S. PATENT DOCUMENTS 3,961,378 A * 6/1976 White ..... 29/594
4,291,781 A * 9/1981 Niguchi et al. ..... 181/169
4,315,557 A * 2/1982 Nakaya et al. ..... 181/168
5,031,720 A * 7/1991 Ohta et al. ..... 181/169

(Continued)

FOREIGN PATENT DOCUMENTS

JP 48-58825 A 8/1973

(Continued)

OTHER PUBLICATIONS

International Search Report for PCT/JP2008/001851, Nov. 11, 2008.

*Primary Examiner* — Edgardo San Martin
(74) *Attorney, Agent, or Firm* — RatnerPrestia

(57) ABSTRACT

A speaker diaphragm which includes a woven cloth which contains a thermosetting resin of thermo-cured state, and a paper board bonded and integrated with the woven cloth at the back surface. The woven cloth has its weave texture exposed on the front surface. The diaphragm has a high strength because it is made with a woven cloth; furthermore, its hardness is high because the thermosetting resin impregnated in woven cloth is in thermo-cured state. Thus the diaphragm helps implementing a speaker which demonstrates superior vibration characteristics in the high frequency sound region.

15 Claims, 15 Drawing Sheets

U.S. PATENT DOCUMENTS 5,206,466 A * 4/1993 Inamiya ..... 181/169
5,274,199 A * 12/1993 Uryu et al. ..... 181/169
5,329,072 A * 7/1994 Kageyama et al. ..... 181/167
5,701,359 A * 12/1997 Guenther et al. ..... 381/431
7,678,218 B2 * 3/2010 Suzuki et al. ..... 156/196
7,706,564 B2 * 4/2010 Hachiya et al. ..... 381/423
2005/0051380 A1 * 3/2005 Takayama et al. ..... 181/170
2006/0249327 A1 * 11/2006 Sato et al. ..... 181/167

FOREIGN PATENT DOCUMENTS

JP 59-106289 U 7/1984
JP 64-82800 A 3/1989

* cited by examiner

DIAPHRAGM FOR SPEAKER, SPEAKER USING THE DIAPHRAGM FOR SPEAKER, AND PROCESS FOR PRODUCING THE DIAPHRAGM FOR SPEAKER

This application is a U.S. National Phase Application of PCT International Application PCT/JP2008/001851.

TECHNICAL FIELD

The present invention relates to a diaphragm for speaker, a speaker which includes the diaphragm and a method of manufacturing the diaphragm.

BACKGROUND ART

Characteristics of a speaker diaphragm greatly depend on the propagation velocity and the internal loss. Namely, a speaker diaphragm having the higher propagation velocity exhibits superior vibration characteristics in the high frequency sound range, and the one having the greater internal loss hardly causes the resonance phenomenon and reproduces the sounds of superior quality.

In general, however, diaphragms having the higher propagation velocity show the smaller internal loss while those having the greater internal loss are slow in the propagation velocity. Therefore, it has been important for a diaphragm to have an appropriate internal loss and an appropriate velocity of propagation, as well as smooth vibration characteristics.

Aiming to implement such a speaker diaphragm, it has been proposed, as shown in FIG. 27, to overlay paper sheet 72 on non-woven fabric mat 71 which is impregnated with phenol resin or the like thermosetting resin, and draw them in heat to be unitized by thermo compression bonding. Diaphragm 73 is completed by thermo-curing the thermosetting resin (Patent Document 1). Namely, in conventional speaker diaphragm 73, the hardness of the non-woven fabric which is a constituent of the diaphragm was raised by thermo-curing the thermosetting resin, and paper sheet 72 having a great internal loss was affixed unitized with non-woven fabric mat 71 in order to offer a speaker of quality sounds.

The above-described conventional diaphragm 73 showed smooth vibration characteristics for the whole sound range. However, the diaphragm 73 was unable to produce satisfactory vibration characteristics in the high frequency sound region because of the slow propagation velocity of paper sheet 72.

[Patent Document 1]

Unexamined Japanese Utility Model Publication No. S59-106289

SUMMARY OF THE INVENTION

The present invention offers a speaker diaphragm which exhibits superior vibration characteristics at high sound region.

A speaker diaphragm in the present invention includes a woven cloth impregnated with a thermosetting resin, which is in the thermo-cured state, and a paper board which is bonded to be unitized with the woven cloth at the back surface. The woven cloth has weave texture exposed on the surface that is opposite to that making contact with the paper sheet.

A diaphragm in the present invention has a higher strength since it is made with woven cloth; its hardness is also high because the impregnated thermosetting resin is in the thermo-cured state. Thus, the present invention offers a speaker diaphragm which is superior in the vibration characteristics at high frequency sound range, and a speaker which includes the diaphragm.

REFERENCE MARKS IN THE DRAWINGS)

1, 205, 305 Woven Cloth
2, 306 Paper Board
3, 207, 307 Longitudinal Thread
4, 208, 308 Latitudinal Thread
5, 209, 311 Weave Texture
6 Upper Metal Mold
7 Lower Metal Mold
8 Net
8*a* Pulp Fiber Layer
10 Magnetic Gap
11 Magnetic Circuit
12 Lead Wire
13 Voice Coil
100, 200, 312 Speaker
104, 204, 304 Diaphragm for Speaker
15 Frame
16 First Edge
17 Lead Out Wire
18 Second Edge
19 Suspension Holder
21 Glue
29 Dust Cap
206 Board of Scooped Paper
30, 40 First Metal Mold
31, 41 Second Metal Mold
22, 34 Screen of Scooped Paper
23, 35 Layer of Paper Fiber
309 Paper Layer
310, 36 Mixed Layer of Thermosetting Resin

DETAILED DESCRIPTION OF PREFERRED EMBODIMENTS

First Embodiment

Now in the following, a speaker diaphragm in the present invention, a speaker including the diaphragm, and a method of manufacturing the diaphragm are described in accordance with the first exemplary embodiment of the present invention.

Figure 1:
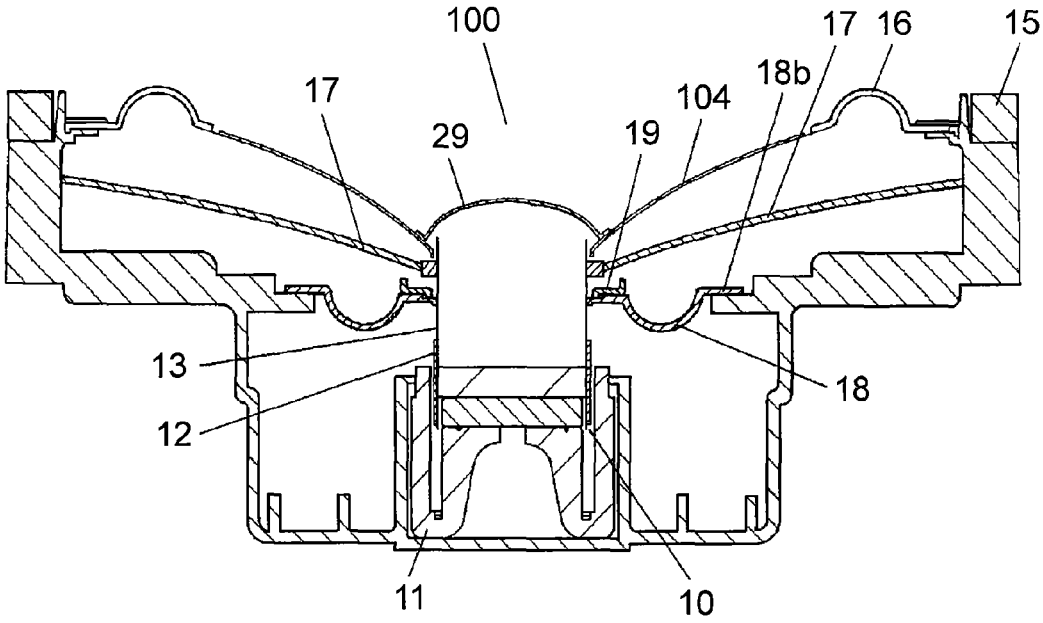
FIG. 1 is a cross sectional view showing a speaker in accordance with the first exemplary embodiment of the present invention.

FIG. 1 shows the cross sectional view of a speaker in accordance with the first exemplary embodiment of the present invention. Referring to FIG. 1, speaker 100 includes magnetic circuit 11 which has magnetic gap 10 of cylindrical shape, cylinder-shaped voice coil 13 the section of lead wire 12 of which is disposed in magnetic gap 10 of magnetic circuit 11 so as the coil can move freely in there, disc shape diaphragm 104 which is connected at the inner circumference with voice coil 13 in a region which is outside of magnetic gap 10, and first edge 16, ring-shaped as viewed from the above, which is connected with diaphragm 104 at one end that is opposite to that connected with voice coil 13 while the other end of the first edge is held by the upper opening part of frame 15.

Lead out wire 17 coming from lead wire 12 of voice coil 13 is guided towards frame 15 keeping the non-contact status with respect to diaphragm 104, from a certain place (middle place) of voice coil 13 between the point where diaphragm 104 is connected to and the section staying within magnetic gap 10.

Voice coil 13 is further connected with second edge 18 which is made of an elastic material formed in a ring shape, as viewed from the above. One end of second edge 18 is connected with voice coil 13 at a certain place between the point where lead out wire 17 is taken from and the section staying within magnetic gap 10. The other end of second edge 18 is made to have contact with frame 15 at a certain place of inner surface in the middle part.

These second edge 18 and first edge 16 are made with urethane, rubber or the like elastic material. The shape of second edge 18 is swelling out downward, whereas that of first edge 16 is swelling out upward, viz. in the opposite direction to each other.

Further provided on second edge 18 is suspension holder 19 which is made of a hard material and ring-shaped as viewed from the above. The suspension holder is disposed on the upper surface (the surface at the diaphragm 14 side) close to the place of connection with voice coil 13. Suspension holder 19 is glued so as it is integrated with the voice coil.

Figure 2:
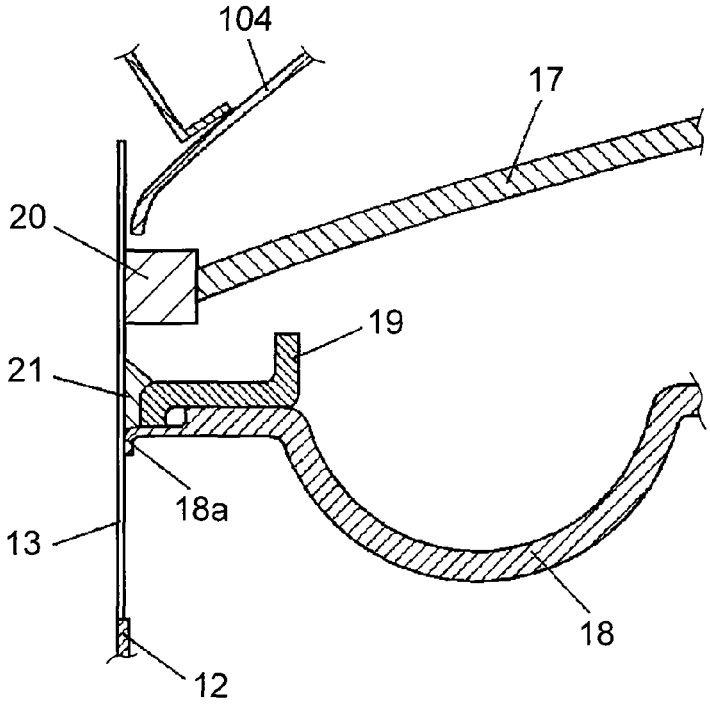
FIG. 2 is a magnified cross sectional view which shows the key part of the speaker in the first embodiment.

FIG. 2 is a magnified cross sectional view showing the key part of a speaker in accordance with the first embodiment. In FIG. 2, portion 18*a* of second edge 18 extended for connection with voice coil 13 is bent towards inside to be inner than suspension holder 19; the thickness of this portion is even thinner than that of the other end which is connected with frame 15 (18*b* in FIG. 1). A stranded wire, so-called tinsel code, is used for lead out wire 17. The inner end of the code is connected by means of solder 20 both electrically and mechanically to the end (not shown) of lead wire 12 at somewhere in the middle part of outer circumferential surface of voice coil 13.

The procedure of assembling a speaker in accordance with the first exemplary embodiment of the present invention is as follows.

As the first step, mount magnetic circuit 11 in frame 15, attach second edge 18 in frame 15, and then dispose voice coil 13 from above the frame 15 so as the lower end goes down through the opening of second edge 18. Place lead wire 12 at a certain specified position in magnetic gap 10 and hold it there (in this stage, suspension holder 19 has already been attached glued on the upper surface of second edge 18).

And then, dispense glue 21 downward from above the extended portion 18*a* of second edge 18 so as it proceeds to reach onto the upper surface of suspension holder 19 and extended portion 18*a* as well as the neighboring region of suspension holder 19. In this way, suspension holder 19 is attached to and held by voice coil 13 as if they constitute a single piece.

In the above-described assembly, since voice coil 13 is wound around in the lower end with lead wire 12, the diameter of outer circumference at the bottom end portion is greater than that at the middle and upper sections.

However, because second edge 18 is made with an elastic material, the second edge can allow the section of lead wire 12 of voice coil 13 to go through the opening which is elastically deformed for a larger diameter. After the section went through, second edge 18 sticks tight around the outer circumferential surface of voice coil 13 at the middle section by elastically deforming for a smaller diameter.

Therefore, glue 21 dispensed from the above for fixing voice coil 13 and suspension holder 19 together seldom ooze down further beneath second edge 18, because portion 18*a* extended from second edge 18 is sticking tight to the outer circumferential surface of voice coil at the middle section due to elastic deformation for smaller diameter. So, it seldom disturbs the free motion of voice coil 3.

In addition to that the second edge 18 is made with an elastic member, the configuration that the thickness of portion 18*a* extended from second edge 18 is made to be thinner helps the above-described elastic deformations for larger diameter and for smaller diameter taking place easily. Thus, the prevention of possible disturbance on the free motion of voice coil 13 is further ensured. As shown in FIG. 2, portion 18*a* extended from second edge 18 is bent downward and makes tight contact to the outer circumferential surface of voice coil 13 in substantially large square measures, for the purpose of preventing glue 21 from oozing down.

Next, connect lead out wire 17 and place diaphragm 104 so as the outer circumferential surface of voice coil 13 at the upper end pushes out from the inner circumference of diaphragm 104. Fix with glue the outer circumferential surface voice coil 13 with the inner circumference of diaphragm 104, and the upper opening of frame 15 with ring-shaped first edge 16, respectively.

Finally, cover the upper end of voice coil 13 with dust cap 29 to complete the assembling process.

Reference is made to FIG. 1. In speaker 100 in the first embodiment of the present invention, the shape of first edge 16 is swelling upward, while second edge 18 downward. These first edge 16 and second edge 18, each of which is swelling out towards the direction opposite to each other and supporting voice coil 13 at the upper and the middle sections respectively, make the moving coil loads of voice coil 13, up and down, closely resembled.

This is naturally reflected on the up-and-down motion of diaphragm 104. As the result, less distortion is produced from the speaker.

Figure 3:
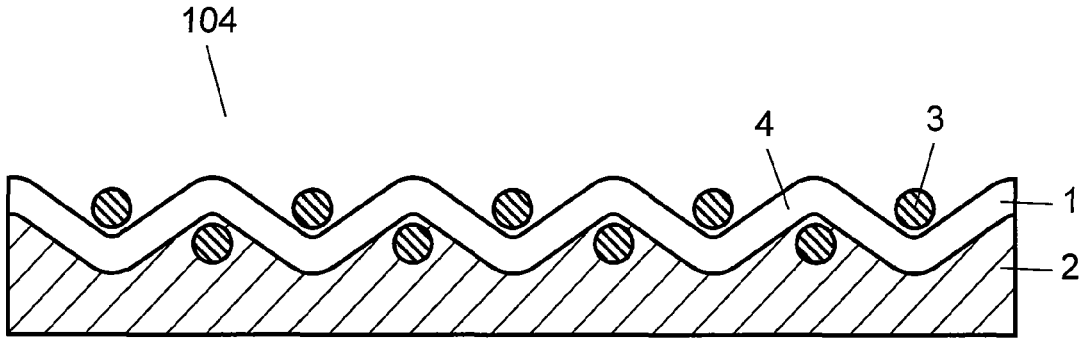
FIG. 3 is a magnified cross sectional view which shows the key part of the diaphragm in accordance with the first embodiment.
Figure 4:
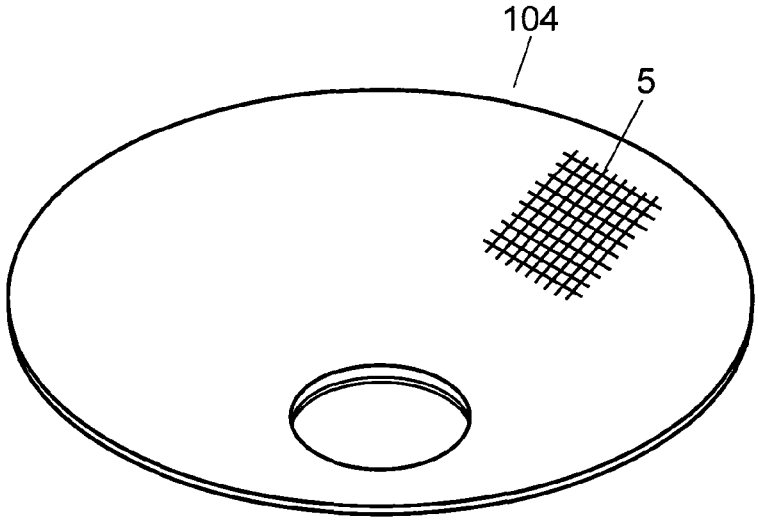
FIG. 4 shows a perspective view of a diaphragm in the first embodiment.

FIG. 3 is a magnified cross sectional view which shows the key part of speaker diaphragm in accordance with the first embodiment. FIG. 4 is a perspective view of the speaker diaphragm in the first embodiment. In FIGS. 3 and 4, the speaker diaphragm includes woven cloth 1 in which an impregnated thermosetting resin is in thermo-cured state, and paper board 2 integrated to the woven cloth at the back surface (the lower surface in FIG. 1) by means of thermo compression bonding. Woven cloth 1 has weave texture 5 produced by longitudinal thread 3 and latitudinal thread 4, which is exposed at the front surface.

Woven cloth 1 contains at least one of the fibers among the group of aramid fiber, polyester fiber, acrylic fiber, cotton fiber, carbon fiber, glass fiber and silk fiber. Instead, it may be provided by employing woven cloth 1 which contains a synthetic fiber and paper board 2 which contains a synthetic fiber, in order to have the synthetic fibers in woven cloth and paper board heat-sealed among each other. The latter configuration enhances the strength of integration between woven cloth 1 and paper board 2.

Woven cloth 1 is consisting of longitudinal threads 3 and latitudinal threads 4, each of these threads contains a thermosetting resin in the inside as well as the surroundings. These longitudinal threads 3 and latitudinal threads 4 as well as woven cloth 1 which is consisting of such threads have been brought into hardened state since the thermosetting resin was thermo-cured. As for the material of thermosetting resin, those which contain at least one resin among the group of phenol resin, acrylic resin, epoxy resin and vinyl-ester resin may be used.

Now in the following, a method of manufacturing diaphragm 104 is described.

Figure 5:
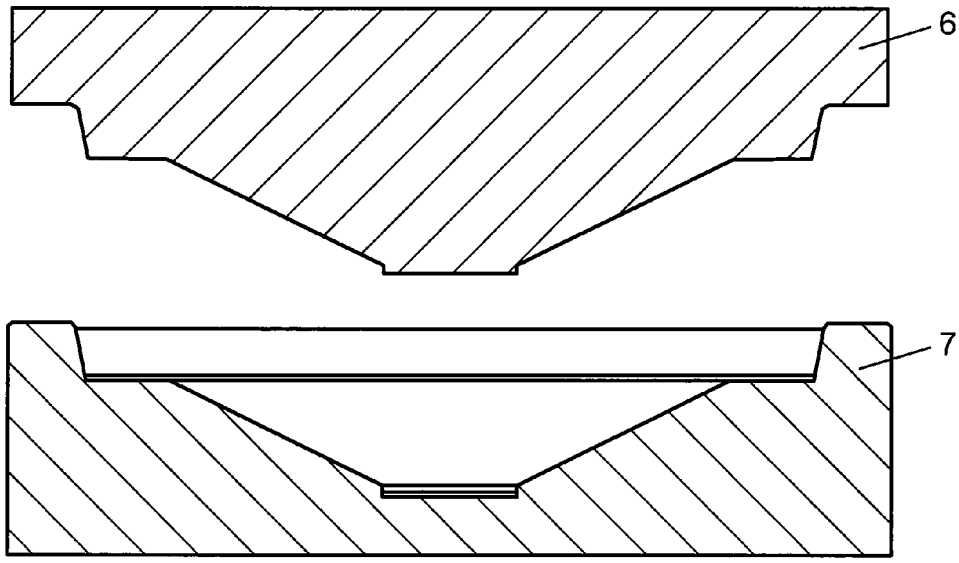
FIG. 5 shows cross sectional views used to describe a method of manufacturing a diaphragm in accordance with the first embodiment.
Figure 6:
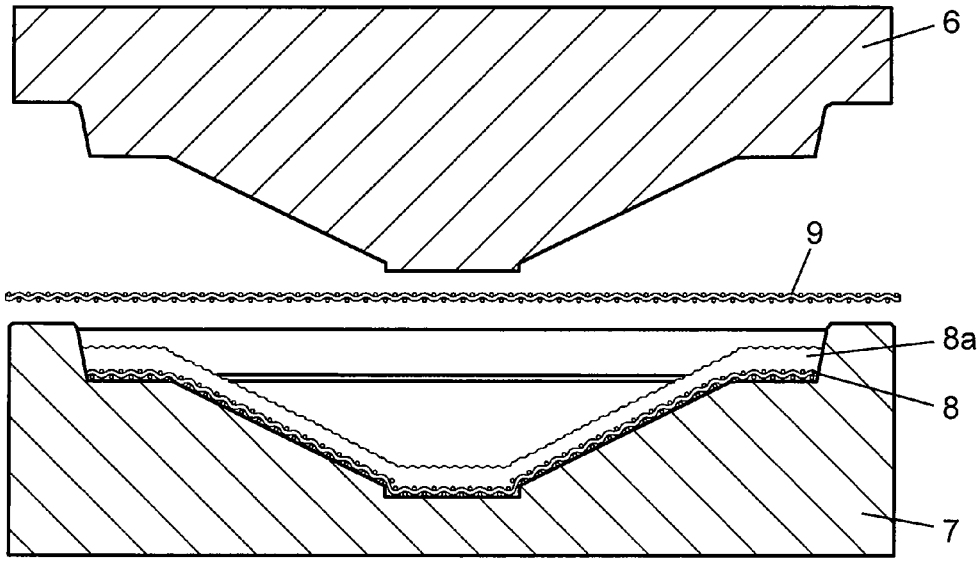
FIG. 6 shows cross sectional views used to describe a method of manufacturing a diaphragm in accordance with the first embodiment.
Figure 7:
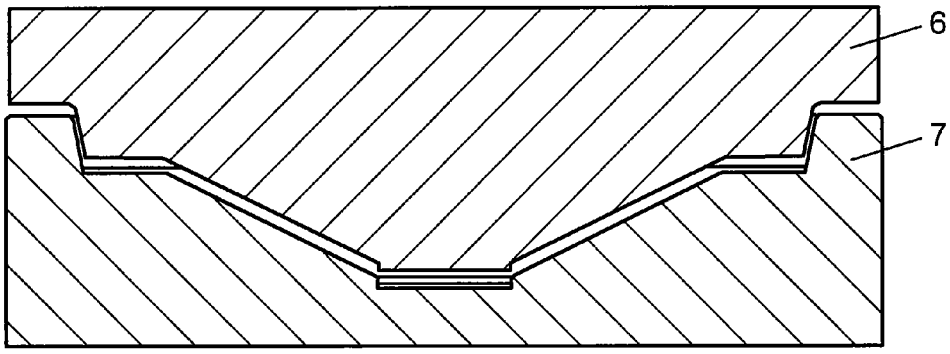
FIG. 7 shows a cross sectional view used to describe a method of manufacturing a diaphragm in accordance with the first embodiment.

FIGS. 5-7 are the cross sectional views used for describing a manufacturing method in accordance with the first exemplary embodiment of the present invention. Reference is made to FIG. 5, upper metal mold 6 and lower metal mold 7 are used for producing diaphragm 104.

Upper metal mold 6 has a conical shape protruding downward, while lower metal mold 7 is designed to be coupled with the conical mold. Respective metal molds are provided with built-in heater (not shown).

In the first place, sufficiently lift upper metal mold 6 upward above lower metal mold 7.

In FIG. 6, place dish-shaped net 8 on lower metal mold 7. Net 8 has on it the pulp fibers which are scooped up out of pulp solution for producing paper board 2. On net 8 is pulp fiber layer 8*a*.

Dispose flat woven cloth 9, which is woven cloth 1 before the molding, between upper metal mold 6 and lower metal mold 7.

In FIG. 7, upper metal mold 6 is lowered onto lower metal mold 7 to have woven cloth 9 and pulp fiber layer 8*a* pressurized and compressed. Then, in the state as they are, heat up to 180° C.~250° C. Diaphragm 104 as shown in FIGS. 3 and 4 is thus produced.

After they are pressurized and heated, woven cloth 1 and paper board 2 disposed at the back surface (the lower surface in FIG. 1) of woven cloth 1 are brought into unitized state by thermo compression bonding. Namely, the thermosetting resin contained within the inside of each of longitudinal threads 3 and latitudinal threads 4 as well as the one surrounding the threads is thermo-cured; consequently, longitudinal threads 3 and latitudinal threads 4 as well as woven cloth 1 which has been woven with the threads are put into hardened state.

Figure 8:
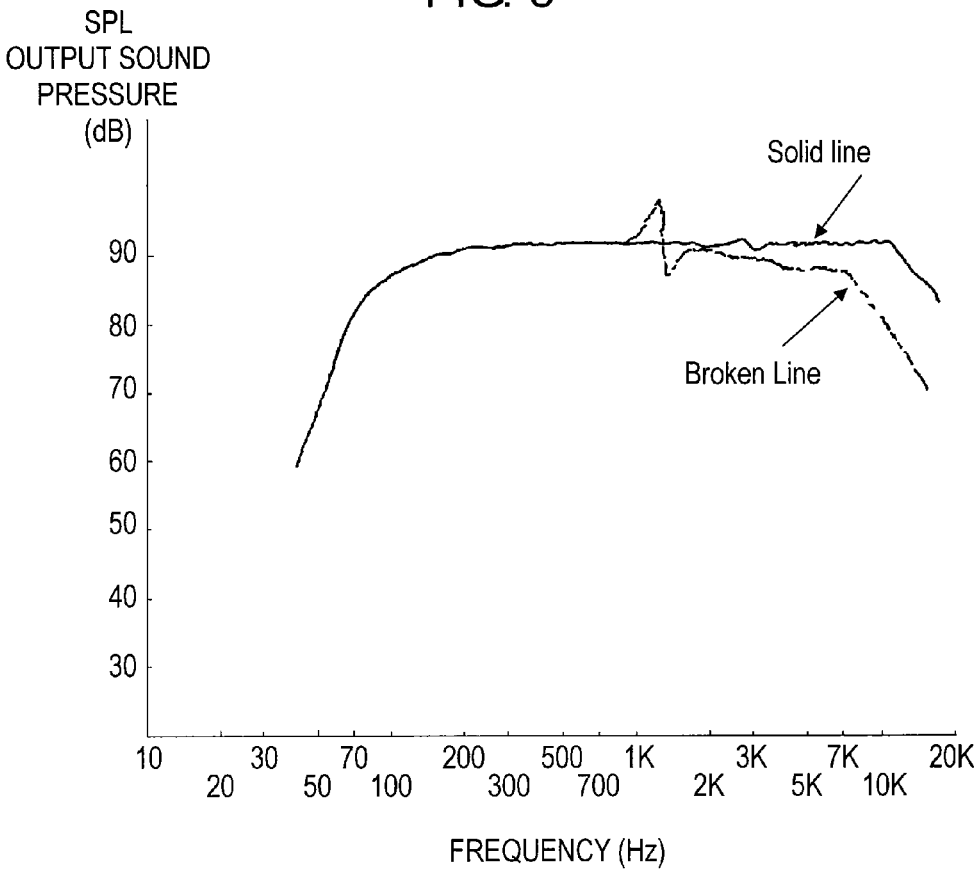
FIG. 8 is a characteristics chart showing the vibration characteristics of a speaker in the first embodiment.

FIG. 8 is a characteristics chart which shows the vibration characteristics of a speaker in accordance with the first embodiment of the present invention. In FIG. 8, the curve in solid line represents vibration characteristics of speaker 100 which includes diaphragm 104 provided in accordance with the present invention. As the chart in FIG. 8 shows, a speaker provided in accordance with the present invention demonstrates superior vibration characteristics in the high frequency sound range. Further, as described earlier, since diaphragm 104 has weave texture 5 formed of longitudinal threads 3 and latitudinal threads 4 which is exposed over the entire front surface (upper surface), local resonance phenomenon hardly arises at the front surface of diaphragm. Thus, flat sound characteristics are offered.

In the chart, the curve in broken line represents the vibration characteristics of a diaphragm which is produced with board of pulp paper alone. In this case, the diaphragm like this one is not hardened. The characteristics deteriorate in the high frequency sound range; it is difficult to extend the marginal frequency of high frequency sounds.

Second Embodiment

A speaker diaphragm in the present invention, a speaker which includes the diaphragm, and a method of manufacturing the diaphragm are described in accordance with the second exemplary embodiment.

Figure 9:
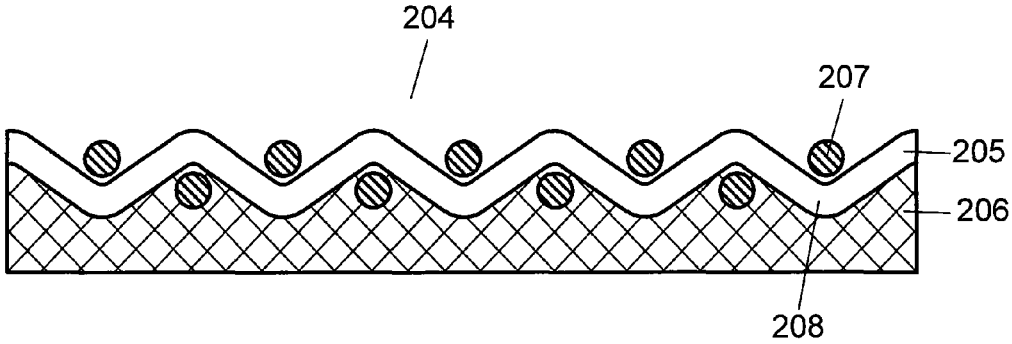
FIG. 9 is a magnified cross sectional view which shows the key part of a diaphragm in accordance with the second exemplary embodiment of the present invention.
Figure 10:
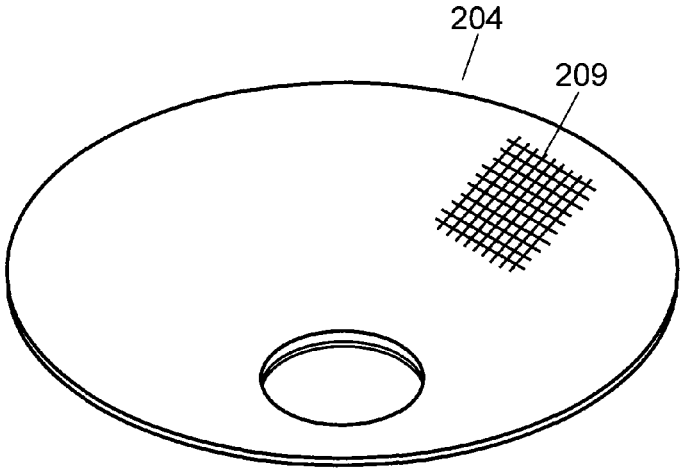
FIG. 10 is a perspective view of a speaker diaphragm in the second embodiment.

FIG. 9 is a magnified cross sectional view which shows the key part of speaker diaphragm in accordance with the second embodiment. FIG. 10 is a perspective view of the diaphragm in the second embodiment. Reference is made to FIGS. 9 and 10, diaphragm 204 in the second embodiment includes board of scooped paper 206 which is integrated with woven cloth 205 at the back surface by means of thermo compression bonding. Woven cloth 205 has weave texture 209 formed of longitudinal thread 207 and latitudinal thread 208, which is exposed at the front surface. Since diaphragm 204 has at its back surface a board of scooped paper 206 which is bonded by thermo compression, the air does not penetrate through it from the front surface to the back surface. Woven cloth 205 is consisting of longitudinal threads 207 and latitudinal threads 208, each of these threads contains a thermosetting resin (not shown) in the inside as well as their surroundings. Longitudinal threads 207 and latitudinal threads 208 as well as woven cloth 205 consisting of such threads have been brought into hardened state since it was thermo-cured.

Woven cloth 205 includes at least one of high-strength fibers among the group of aramid fiber, polyester fiber, acrylic fiber, cotton fiber, carbon fiber, glass fiber and silk fiber.

Woven cloth 205 has at the back surface a board of scooped paper 206 made with cellulose fiber alone or the one mixed with a chemical fiber, which is integrated by thermo compression bonding. Board of scooped paper 206 evenly contains a thermosetting resin whose property is identical to the one contained in woven cloth 205; namely, the same thermosetting resin as that contained in woven cloth 205 or the one whose melting point and coefficient of thermal contraction are close to those of the resin contained in woven cloth 205. In the same manner as with woven cloth 205, board of scooped paper 206 has been in the thermo-cured state.

As for the material of thermosetting resin, those resins which contain at least one resin among the group of phenol resin, acrylic resin, epoxy resin and vinyl ester resin can be used.

Figure 11:
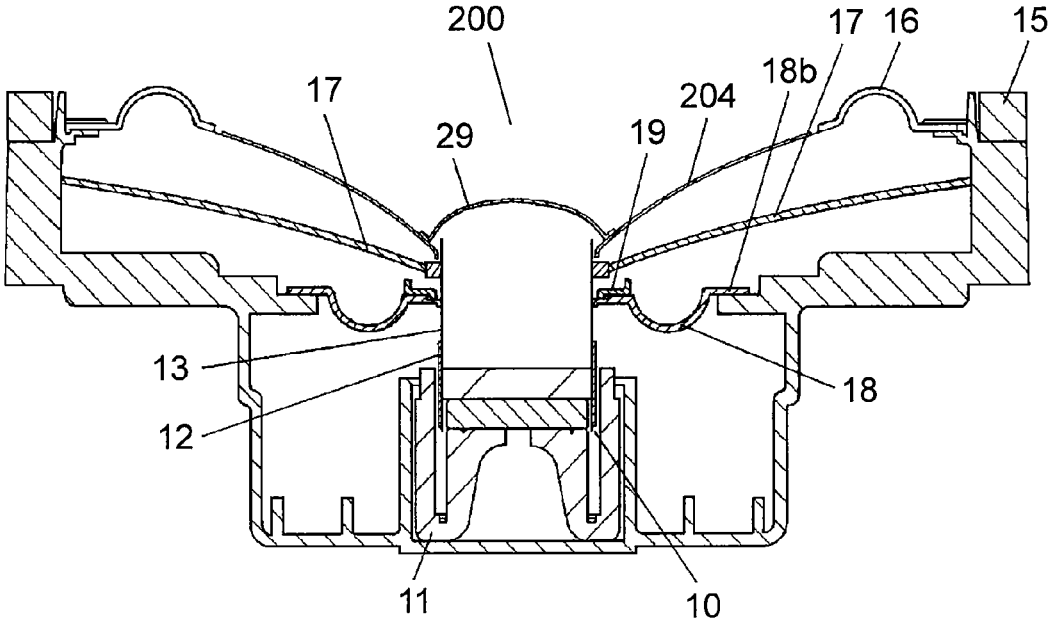
FIG. 11 is a cross sectional view showing a speaker in accordance with the second embodiment.

FIG. 11 shows the cross sectional view of a speaker in the second embodiment of the present invention. In FIG. 11, speaker 200 includes magnetic circuit 11 having cylinder-shaped magnetic gap 10, and voice coil 13 of cylindrical shape the section of lead wire 12 of which is disposed in magnetic gap 10 and can move freely.

Disc-shaped diaphragm 204 is connected at the inner circumference with voice coil 13 in the section which is outside the magnetic gap 10. Outer circumference of diaphragm 204 is connected with the inner circumference of ring-shaped first edge 16, as viewed from the above, which is supported by the upper opening section of dish-shaped frame 15. Semi-spherical dust cap 29 is provided at the vicinity of inner circumference of diaphragm 204, in order to prevent dust particles, humid air, etc. intruding into the inside of speaker 200.

Lead out wire 17 from lead wire 12 of voice coil 13 is taken out from a certain place (middle section) of voice coil 13 between the point of connection with diaphragm 204 and the section which stays in magnetic gap 10 to be guided towards frame 15, keeping the free-of-contact state with respect to diaphragm 204.

Further, voice coil 13 is connected at a certain place between the point where lead out wire 17 is led out and the section which says in magnetic gap 10 with one of the ends of second edge 18 which is made with an elastic material formed in a ring shape as viewed from the above. The other end of second edge 18 is in contact with inner surface of frame 15 in the middle part.

These second edge 18 and first edge 16 are formed with urethane, rubber or the like elastic material. Second edge 18 is shaped swelling downward, whereas first edge 16 swelling upward; thus, they are swelling in the directions opposite to each other.

In the configuration that first edge 16 and second edge 18 have been shaped to swell towards directions opposite to each other, the moving coil loads of voice coil 13 up and down are made to be closely resembled among each other. This is naturally reflected on the up and down behavior of diaphragm 204. Consequently, distortion contained in the sounds reproduced from speaker 200 can be reduced.

When voice coil 13 of speaker 200 receives sound signal, magnetic field of magnetic circuit 11 reacts and voice coil 13 is driven up and down by electromotive force in accordance with the Fleming's left hand rule. Diaphragm 204 connected at the inner circumference with voice coil 13 moves accordingly to vibrate the air. Speaker 200 generates sounds in this way.

Diaphragms made with a board of scooped paper which employs such materials as pulp, carbon, etc. for the base material, however, can not offer satisfactory vibration characteristics in the high frequency sound region, due to slow propagation velocity of the board of scooped paper.

Therefore, in diaphragm 204 in the second embodiment, board of scooped paper 206 is impregnated with a thermosetting resin at the surfaces at the woven cloth side and the opposite side. This configuration is effective to improve the vibration characteristics at the high frequency sound region, because the impregnated thermosetting resin has been thermo-cured and the hardness of board of scooped paper 206 is raised. As the result of increased hardness with board of scooped paper 206, the velocity of propagation increases, which implements improved vibration characteristics of diaphragm 204 in the high frequency region.

Furthermore, since board of scooped paper 206 of diaphragm 204 in the second embodiment has been thermo-cured with the thermosetting resin, the strength to withstand a stress caused during sound reproduction of speaker 200 has been enhanced. So, in addition to the improved vibration characteristics in high frequency sound region as described above, diaphragm 204 has reduced possibility of mechanical breakage.

Board of scooped paper 206 may be impregnated with thermosetting resin also into the inside. By so doing, the hardness of board of scooped paper 206 can further be increased, and the vibration characteristics in high frequency sound region can be improved further.

Board of scooped paper 206 in the second embodiment is impregnated with a thermosetting resin having a property which is identical with that of the one used for woven cloth 205. As the result, the tightness of contact at the border between board of scooped paper 206 and woven cloth 205 is increased to a sufficient bonding strength. Thus, toughness of diaphragm 204 can be increased further.

It is preferred to have weave texture 209 exposed on woven cloth 205 at the surface that is opposite to the junction with board of scooped paper 206. By so doing, occurrence of the local resonance phenomenon at the front surface of diaphragm 204 can be avoided.

As for the material of thermosetting resin for impregnation in woven cloth 205, it is preferred to use the one which contains at least one resin among the group of phenol resin, acrylic resin, epoxy resin and vinyl ester resin. Those resins which contain such a resin can be thermo-cured to a satisfactory hardness during the process of thermo compression bonding. Thus the hardness of diaphragm 204 is increased, and the vibration characteristics of diaphragm 204 can be improved in the high frequency sound region.

Woven cloth 205 may be made with a woven cloth which contains at least one fiber among the group of aramid fiber, polyester fiber, acrylic fiber, cotton fiber, carbon fiber, glass fiber and silk fiber. Such a woven cloth containing the fiber can increase the strength of woven cloth 205. As the result, the hardness of diaphragm 204 can be enhanced, and the vibration characteristics improved in the high frequency sound region.

Now in the following, a method of manufacturing diaphragm 204 is described.

Figure 12:
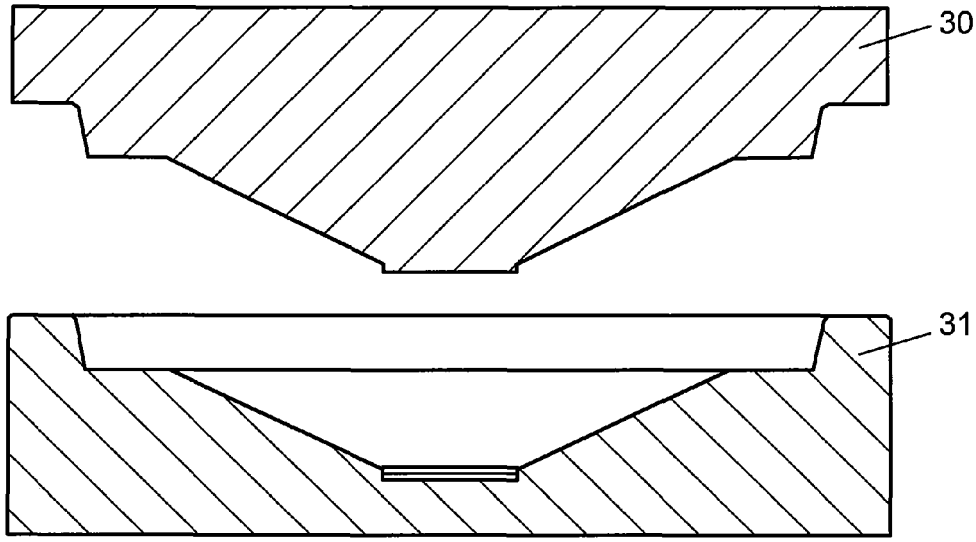
FIG. 12 shows cross sectional views used to describe a method of manufacturing a diaphragm in the second embodiment.

FIGS. 12-17 are cross sectional views used to describe a method of manufacturing the diaphragm in accordance with the second exemplary embodiment of the present invention. FIG. 12 shows how a molding facility is formed with first metal mold 30 and second metal mold 31 for producing diaphragm 204.

First metal mold 30 has a conical shape protruding downward, while second metal mold 31 is bowl-shaped for coupling with the conical metal mold. Respective metal molds have built-in heater (not shown).

In the first place, lift first metal mold 30 upward to be sufficiently high above second metal mold 31.

Figure 13:
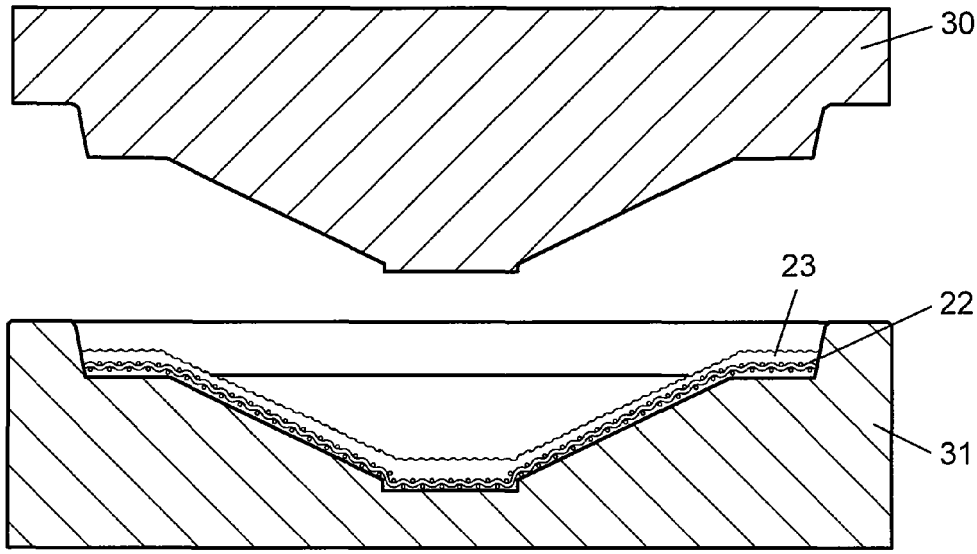
FIG. 13 shows cross sectional views used to describe a method of manufacturing a diaphragm in the second embodiment.

Reference is made to FIG. 13. Place dish-shaped screen of scooped paper 22 on second metal mold 31. On the screen of scooped paper 22 are pulp fibers which have been scooped up from a pulp solution for producing board of scooped paper 206. There is layer of paper fiber 23 on screen of scooped paper 22. Layer of paper fiber 23 at this stage is approximately 10 mm thick. It is preferred to apply a mold releasing agent on screen of scooped paper 22. Then, screen of scooped paper 22 can be easily peeled off from board of scooped paper 206 after the molding process is finished.

Figure 14:
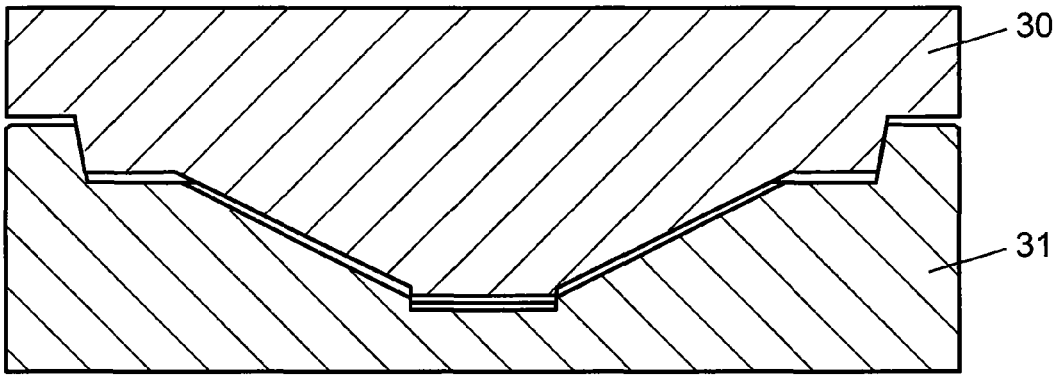
FIG. 14 shows a cross sectional view used to describe a method of manufacturing a diaphragm in the second embodiment.

Referring to FIG. 14, lower first metal mold 30 towards second metal mold 31 to have layer of paper fiber 23 compressed. The compression is aimed to have moistures contained in layer of paper fiber 23 evaporated. Layer of paper fiber 23 can be compressed appropriately by setting the built-in heating facility (not shown) provided in first metal mold 30 and second metal mold 31 at certain low temperature, and adjusting the time of compression.

Figure 15:
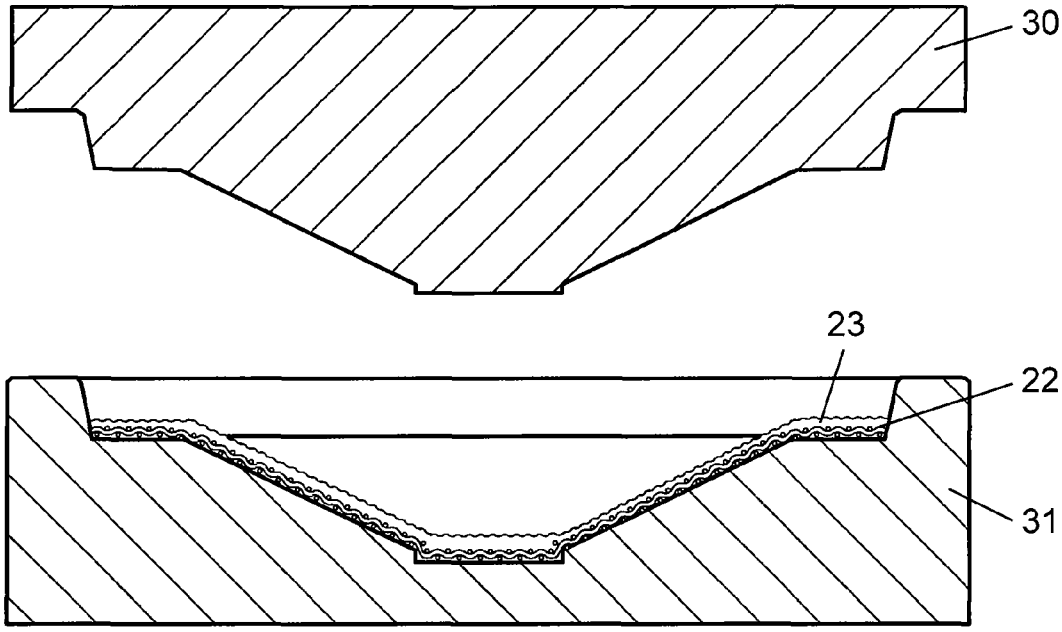
FIG. 15 shows cross sectional views used to describe a method of manufacturing a diaphragm in the second embodiment.

Referring to FIG. 15, lift open first metal mold 30 from second metal mold 31. Layer of paper fiber 23 on second metal mold 31 is reduced to approximately 3 mm thick and its rough surface became smoother, as compared to that before the compression. From second metal mold 31, remove layer of paper fiber 23 as it is together with screen of scooped paper 22, or only the layer of paper fiber 23 alone. Immerse it in a vessel which has been filled with a fluid-state thermosetting resin for impregnation. The thermosetting resin starts permeating into layer of paper fiber 23, from the screen of scooped paper 22 side and the opposite side; the resin further proceeds also to the inside of layer of paper fiber 23. Layer of paper fiber 23 may be impregnated with thermosetting resin by painting, or spraying, the resin at the upper and the lower surfaces in the state shown in FIG. 15. Or, the resin may be delivered to be existing in the front and back surface as well as the inside of layer of paper fiber 23 by painting, or spraying, on the upper surface of layer of paper fiber 23, and then sucking the resin towards the bottom part of second metal mold 31.

Figure 16:
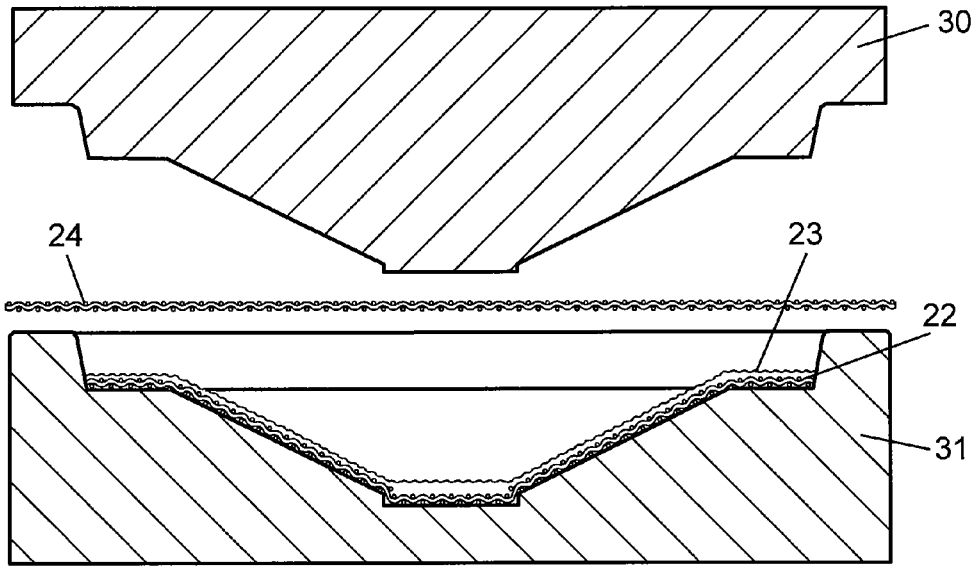
FIG. 16 shows cross sectional views used to describe a method of manufacturing a diaphragm in the second embodiment.

Then, refer to FIG. 16; dispose flat woven cloth 24, which is before it is formed into woven cloth 205, between first metal mold 30 and second metal mold 31. Woven cloth 24 has already been impregnated with a thermosetting resin having the same property as that used for impregnating the entire layer of paper fabric 23.

Figure 17:
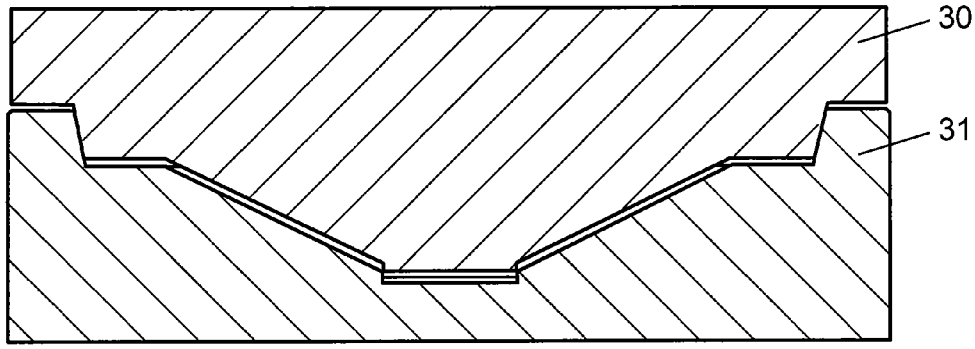
FIG. 17 shows a cross sectional view used to describe a method of manufacturing a diaphragm in the second embodiment.

Lower first metal mold 30 down to second metal mold 31, as shown in FIG. 17, in order to have woven cloth 24 and layer of paper fiber 23 pressurized and compressed. Then, respective thermosetting resins contained in woven cloth 24 and layer of paper fiber 23 are mixed among each other.

With woven cloth 24 and layer of paper fiber 23 kept in the pressurized state, heat first metal mold 30 and second metal mold 31 to 180° C.~250° C. in order to thermo-cure the mixed thermosetting resin for integrating woven cloth 24 and layer of paper fiber 23. Woven cloth 24 and layer of paper fiber 23 thus integrated are taken out of molding facility. Screen of scooped paper 22 is peeled away from layer of paper fiber 23. Diaphragm 204 as shown in FIGS. 9 and 10 is thus provided.

As described in the above, a manufacturing method in accordance with the second embodiment implements the high hardness of diaphragm 204 by thermo-curing thermosetting resins contained in board of scooped paper 206 and woven cloth 205. As the result, the propagation velocity with board of scooped paper 206 is raised and the vibration characteristics of diaphragm 204 can be improved in the high frequency sound region.

Diaphragm 204 in the second embodiment of the present invention offers superior vibration characteristics in the high frequency sound region, which could be used for improving the sound quality of speakers.

Third Embodiment

A speaker diaphragm, a speaker which includes the diaphragm, and a method of manufacturing the diaphragm are described in accordance with the third exemplary embodiment of the present invention.

Figure 18:
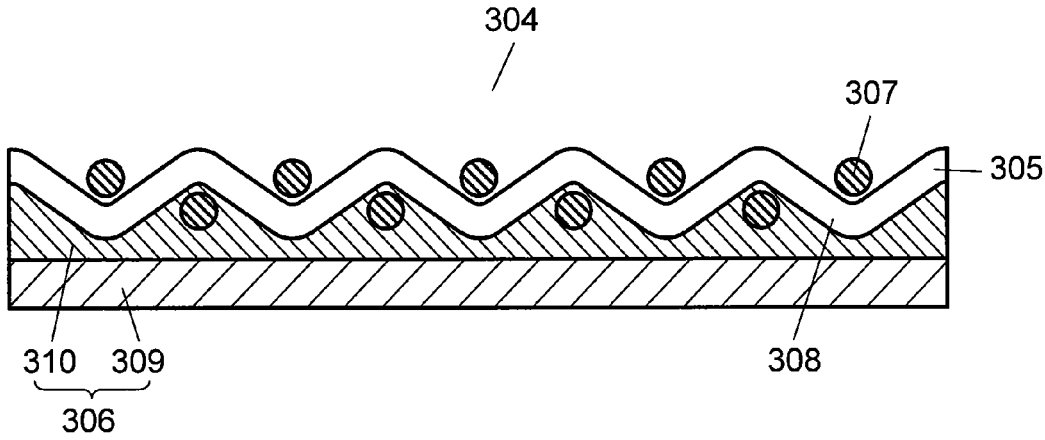
FIG. 18 is a magnified cross sectional view which shows the key part of a diaphragm in the third exemplary embodiment of the present invention.
Figure 19:
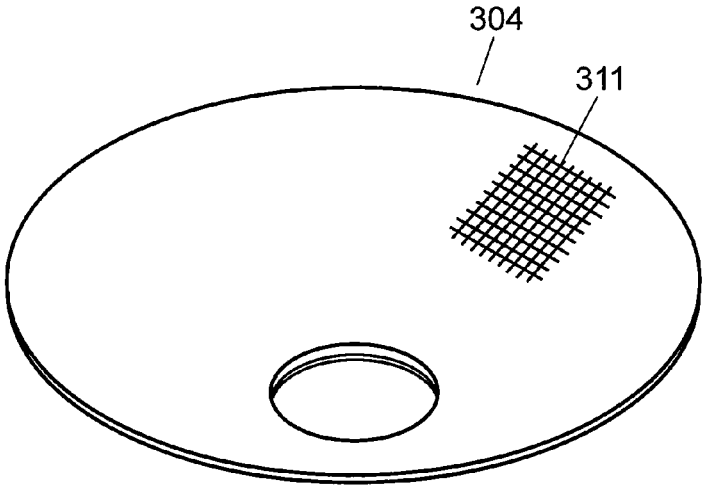
FIG. 19 shows a perspective view of a diaphragm in the third embodiment.

FIG. 18 is a magnified cross sectional view which shows the key part of diaphragm in accordance with the third embodiment. FIG. 19 shows a perspective view of the diaphragm in the third embodiment. Reference is made to FIGS. 18 and 19, diaphragm 304 includes paper board 306 which is integrated with woven cloth 305 at the back surface by means of thermo compression bonding. Woven cloth 305 has weave texture 311 which is formed of longitudinal thread 307 and latitudinal thread 308 and exposed at the front surface.

Woven cloth 305 is consisting of longitudinal threads 307 and latitudinal threads 308, each of these threads contains a thermosetting resin (not shown) in the inside as well as the surroundings. Longitudinal threads 307 and latitudinal threads 308 as well as woven cloth 305 consisting of such threads have been brought into hardened state since the thermosetting resin was thermo-cured. Woven cloth 305 includes at least one of fibers among the group of aramid fiber, polyester fiber, acrylic fiber, cotton fiber, carbon fiber, glass fiber and silk fiber.

Paper board 306 which is integrated with woven cloth 305 at the back surface by thermo compression bonding is made with cellulose fiber alone, or the one mixed with a certain chemical fiber. Paper board 306 includes paper layer 309, and mixed layer of thermosetting resin 310 which is paper board 306 impregnated with thermosetting resin. Mixed layer of thermosetting resin 310 is at the woven cloth 305 side as shown in FIG. 18, which layer has been hardened in the same manner as woven cloth 305 by the thermo-cured thermosetting resin.

The thermosetting resin contained in paper board 306 is the one having identical property as that contained in woven cloth 305; namely, the melting point and the heat contraction of them are substantially the same, or close to. Consequently, there is not much difference in the heat contraction at high temperature between the thermosetting resin contained in paper board 306 and that in woven cloth 305; so, paper board 306 and woven cloth 305 are bonded tightly to each other, and there is hardly any gap observed at the interface. As to the material of thermosetting resin, those resins which contain at least one resin among the group of phenol resin, acrylic resin, epoxy resin and vinyl ester resin may be employed.

Figure 20:
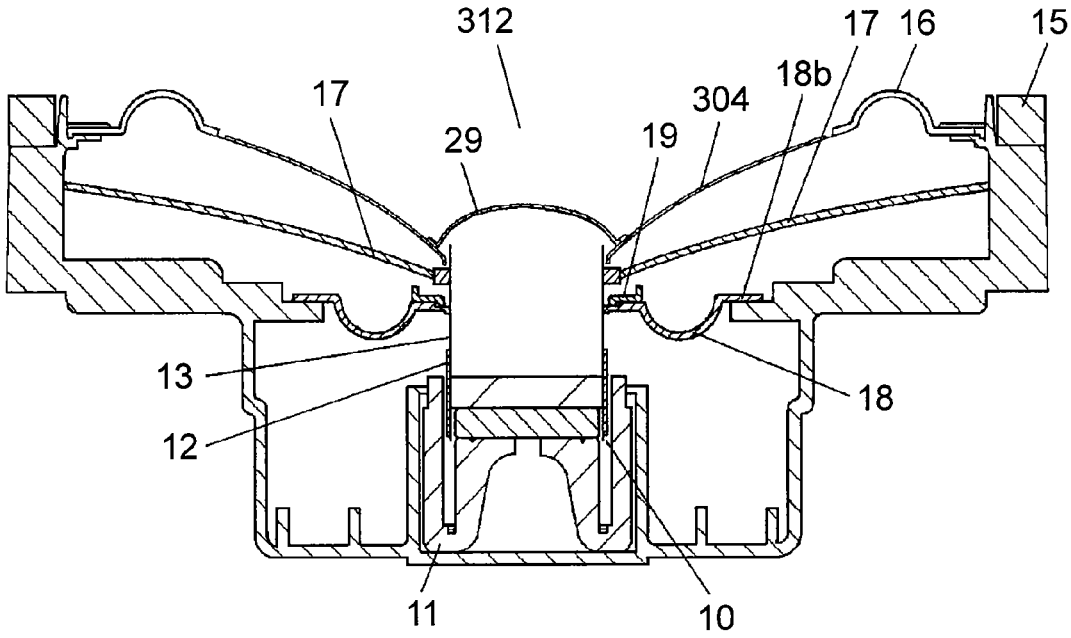
FIG. 20 shows a cross sectional view of a speaker in the third exemplary embodiment of the present invention.

FIG. 20 shows a cross sectional view of a speaker in the third embodiment. In FIG. 20, speaker 312 includes magnetic circuit 11 which has cylinder-shaped magnetic gap 10, and voice coil 13 of cylindrical shape the section of lead wire 12 of which is disposed in magnetic gap 10 in free-moving manner.

Disc-shaped diaphragm 304 is connected at the inner circumference with voice coil 13 at a place not disposed in magnetic gap 10. The outer circumference of diaphragm 304 is connected with the inner circumference of first edge 16 which is ring-shaped as viewed from the above and supported by the upper opening section of dish-shaped frame 15. Dust cap 29 having semi-spherical form is provided on the vicinity of inner circumference of diaphragm 304, in order to prevent dust particles, humid air, etc. coming into the inside of speaker 312.

Lead out wire 17 from lead wire 12 of voice coil 13 is taken out from a certain point of voice coil 13 (middle part) between the place of connection with diaphragm 304 and the section which stays in magnetic gap 10 towards frame 15, maintaining the free-of-contact state with respect to diaphragm 304.

Voice coil 13 is further connected at a certain place between the point where lead out wire 17 is led out and the section which stays in magnetic gap 10 with one end of second edge 18, which is made with an elastic material formed in a ring shape as viewed from the above. The other end of second edge 18 is having contact with the inner surface of frame 15 in the middle part.

These second edge 18 and first edge 16 are formed with urethane, rubber or the like elastic material. Second edge 18 is shaped swelling downward, whereas first edge 16 swelling upward; thus, they are swelling in the direction opposite to each other.

In the configuration that first edge 16 and second edge 18 are shaped swelling towards the directions opposite to each other, the moving coil loads up and down of voice coil 13 are closely resembled.

This is naturally reflected on the up and down movements of diaphragm 304. Consequently, distortion contained in the sounds reproduced by speaker 312 can be reduced.

When AC current containing a sound signal is applied to voice coil 13, it reacts to the magnetic field of magnetic circuit 11 and voice coil 13 moves up and down driven by electromotive force caused in accordance with the Fleming's left hand rule. Diaphragm 304 which is connected at the inner circumference with voice coil 13 moves accordingly to vibrate the air. Speaker 312 generates sounds in this mechanism.

If woven cloth 305 and paper board 306 constituting diaphragm 304 were not bonded together with a sufficient strength, there is a risk that woven cloth 305 and paper board 306 could be separated against each other due to vibrations given by voice coil 13. This causes a trouble with diaphragm 304.

To avoid this to happen, mixed layer of thermosetting resin 310 which contains a resin having identical property as the one contained in woven cloth 305 is given also to paper board 306 in the third embodiment.

The occurrence of an interface caused due to difference in the high temperature heat contraction property and the melting point can be avoided by employing a thermosetting resin which has identical properties as the one contained in woven cloth 305 for mixed layer of thermosetting resin 310 of paper board 306. By so doing, a gap is hardly observed at the interface between paper board 306 and woven cloth 305. Thus, a sufficiently high bonding strength is ensured between paper board 306 and woven cloth 305, and the risk of peeling off with diaphragm 304 can be reduced.

It is preferred that woven cloth 305 has weave texture 311 exposed at the surface that is opposite to the surface bonded with paper board 306.

When weave texture 311 of longitudinal threads 307 and latitudinal threads 308 is exposed over the entire front surface of woven cloth 305, as illustrated in FIG. 19, the occurrence of local resonance phenomenon at the front surface of diaphragm 304 can be prevented. Furthermore, during thermo compression bonding of paper board 306 and woven cloth 305, paper board 306 is injected to be filling the empty spaces existing between longitudinal threads 307 and latitudinal threads 308 forming weave texture 311 of woven cloth 305, as shown in FIG. 18. This enhances the bonding strength even higher.

As to the material of thermosetting resin contained in woven cloth 305, those resins which contain at least one resin among the group of phenol resin, acrylic resin, epoxy resin and vinyl ester resin may be used. These resins can be sufficiently thermo-cured at the thermo compression bonding to an increased hardness of diaphragm 304. Furthermore, a sufficiently high bonding strength can be ensured between paper board 306 and woven cloth 305.

Woven cloth 305 may be provided by using those which contain at least one fiber among the group of aramid fiber, polyester fiber, acrylic fiber, cotton fiber, carbon fiber, glass fiber and silk fiber. Such a woven cloth containing one of the fibers provides an increased strength, and the risk of breakage with woven cloth 305 can be lowered.

Now in the following, a method of manufacturing diaphragm 304 is described.

Figure 21:
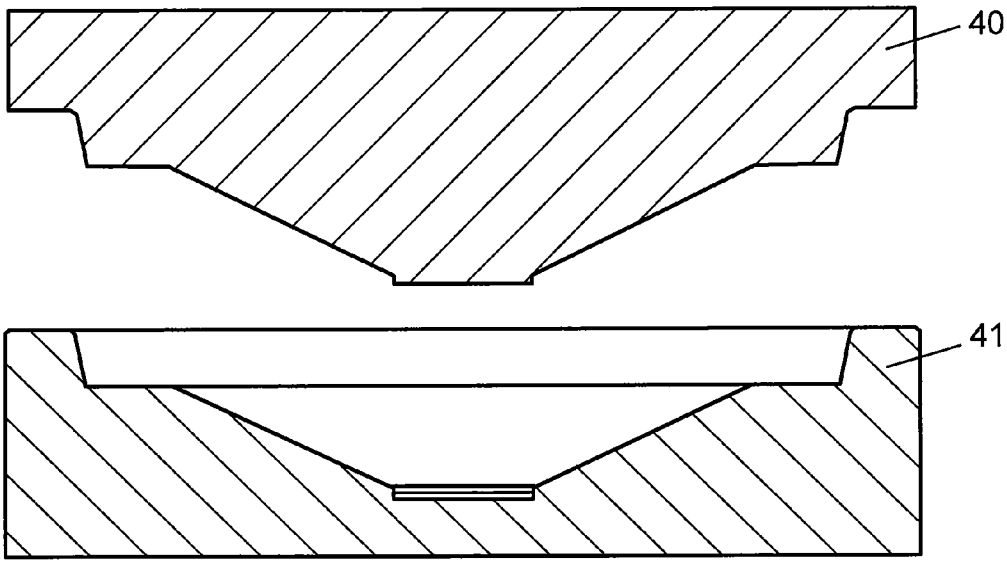
FIG. 21 shows cross sectional views used to describe a method of manufacturing a diaphragm in the third embodiment.

FIGS. 21-26 are cross sectional views used to describe a method of manufacturing a diaphragm in accordance with the third exemplary embodiment of the present invention. Shown in FIG. 21 are first metal mold 40 and second metal mold 41 used for forming diaphragm 304.

First metal mold 40 has a conical shape protruding downward, while second metal mold 41 is bowl-shaped for coupling with the conical mold. Each of these metal molds is provided with built-in heater (not shown) for heating.

First, lift first metal mold 30 upward sufficiently above second mold 31.

Figure 22:
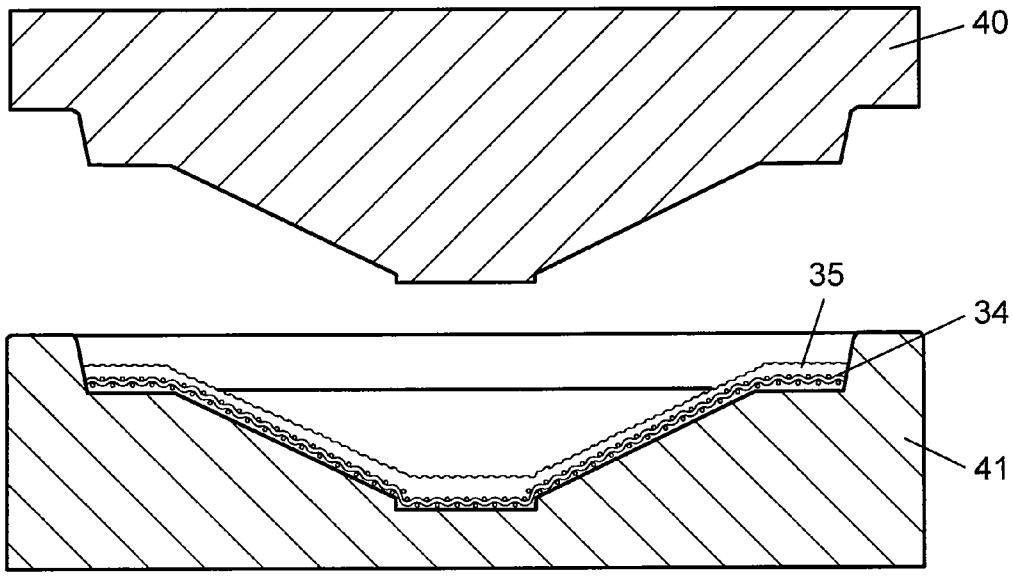
FIG. 22 shows cross sectional views used to describe a method of manufacturing a diaphragm in the third embodiment.

Referring to FIG. 22, place dish-shaped screen of scooped paper 34 on second metal mold 41.

On the screen of scooped paper 34 are pulp fibers which have been scooped up from a pulp solution for producing paper board 306. There is layer of paper fiber 35 on screen of scooped paper 34, which layer of paper fiber in this state is approximately 10 mm thick. It is preferred to apply a mold releasing agent on screen of scooped paper 34. Then, screen of scooped paper 34 can be easily peeled off from paper board 306 after molding is finished.

Figure 23:
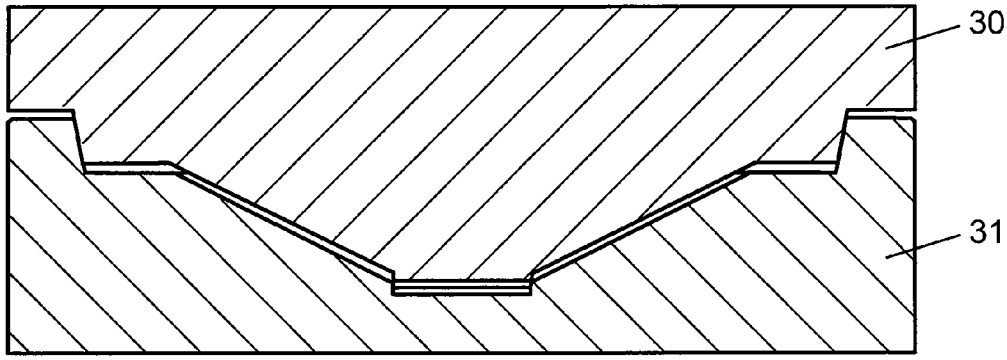
FIG. 23 is a cross sectional view used to describe a method of manufacturing a diaphragm in the third embodiment.

Referring to FIG. 23, lower first metal mold 40 onto second metal mold 41, to have layer of paper fiber 35 compressed. The compression is aimed to have moistures contained in layer of paper fiber 35 evaporated. Layer of paper fiber 35 can be compressed appropriately by setting the built-in heating facilities of first metal mold 40 and second metal mold 41 at low temperature, and adjusting the time of compression.

Figure 24:
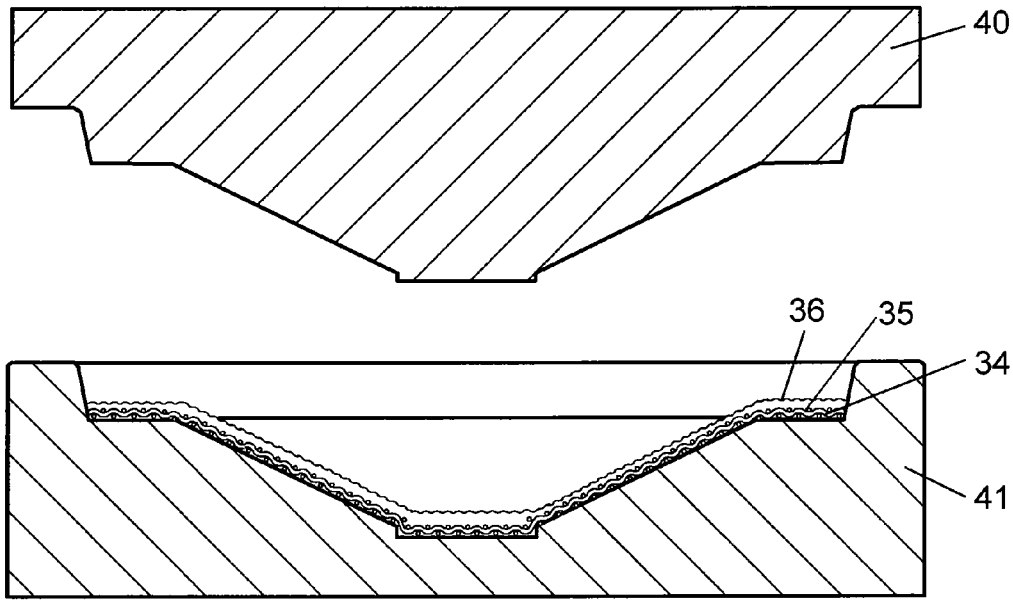
FIG. 24 shows cross sectional views used to describe a method of manufacturing a diaphragm in the third embodiment.

In FIG. 24, lift open first metal mold 40 from second metal mold 41. Layer of paper fiber 35 on second metal mold 41 at this stage is approximately 3 mm thick, and the surface roughness became smoother, as compared to that before the compression. Then, apply a thermosetting resin in fluid state to layer of paper fiber 35 by painting it on the upper surface. The resin permeates into layer of paper fiber 35 to form mixed layer of thermosetting resin 36 in layer of paper fiber 35. The mixed layer of thermosetting resin 36 formed in layer of paper fiber 35 compares to the mixed layer of thermosetting resin 310 in paper board 306 of diaphragm 304 shown in FIG. 18. Although thermosetting resin is applied by means of painting method in the third embodiment, it is to be understood that it is not the intension to limit the method of application to painting; it may be applied instead by means of spraying method.

Figure 25:
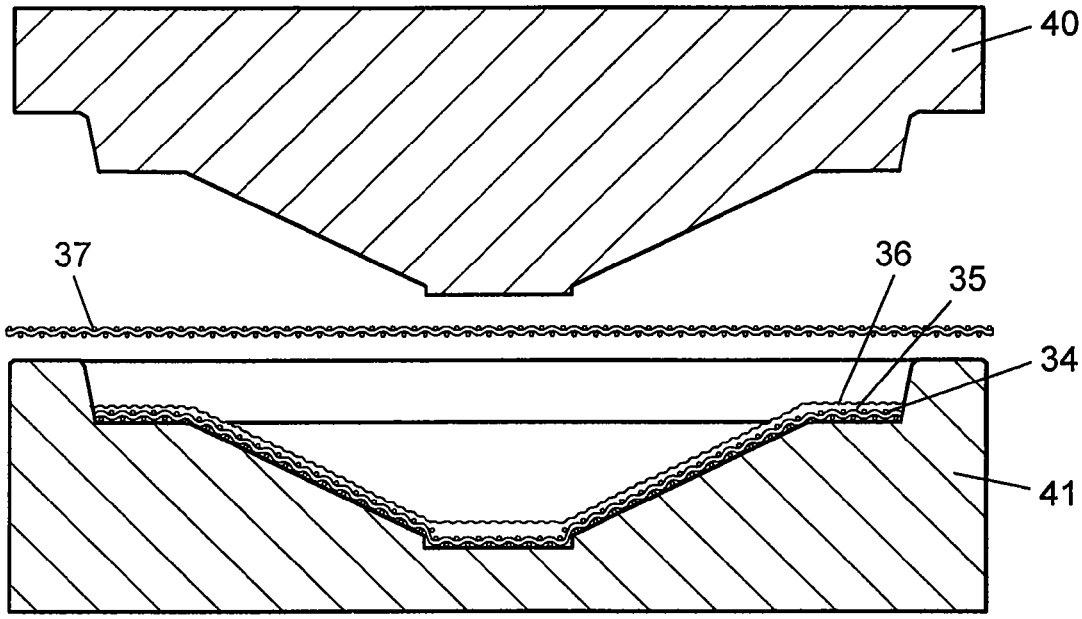
FIG. 25 shows cross sectional views used to describe a method of manufacturing a diaphragm in the third embodiment.

Then, refer to FIG. 25; dispose woven cloth 37, which being in the flat state before it is formed into woven cloth 305, between first metal mold 40 and second metal mold 41. Woven cloth 37 has already been impregnated with a thermosetting resin which has identical property as the one which was used for impregnating layer of paper fiber 35.

Figure 26:
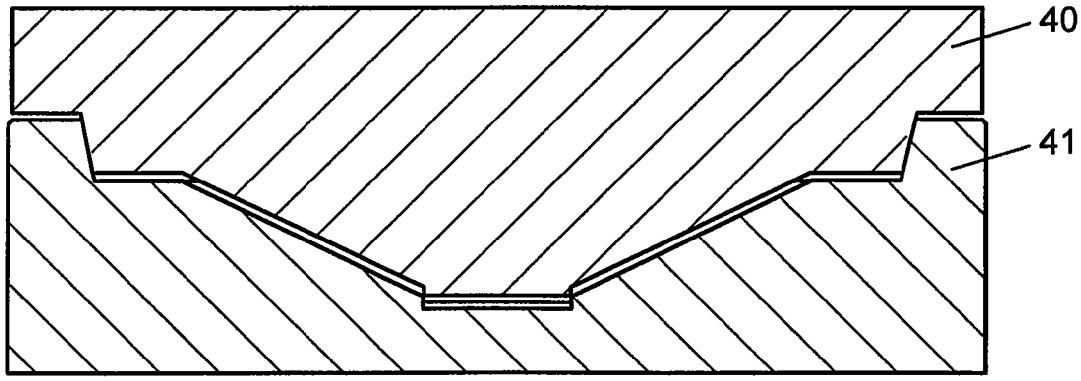
FIG. 26 is a cross sectional view used to describe a method of manufacturing a diaphragm in the third embodiment.
Figure 27:
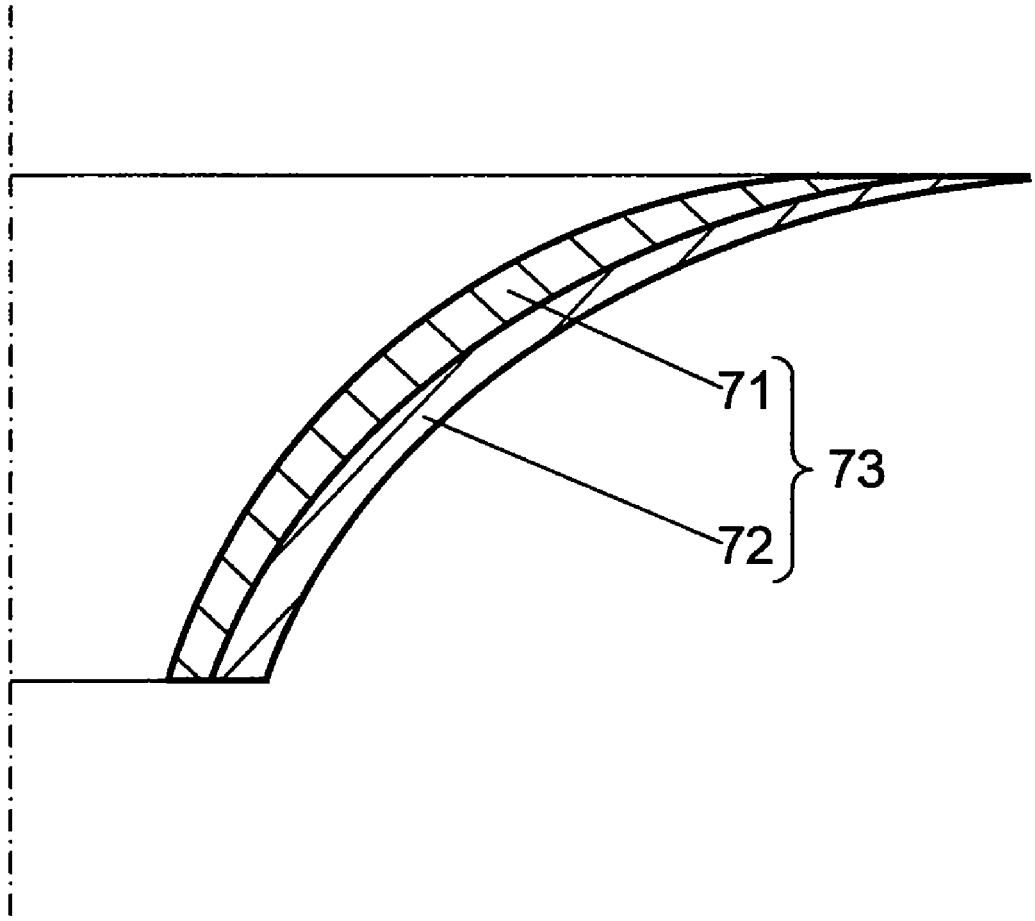
FIG. 27 PRIOR ART
FIG. 27 is a cross sectional view showing the key part of a typified conventional diaphragm for speaker.

Next, lower first metal mold 40 down to second metal mold 41, as shown in FIG. 26, to have woven cloth 37 and layer of paper fiber 35 pressurized and compressed together. As the result, respective thermosetting resins contained in woven cloth 37 and layer of paper fiber 35 are mixed among each other.

With woven cloth 37 and layer of paper fiber 35 kept in the compressed state, heat first metal mold 40 and second metal mold 41 to 180° C.~250° C. in order to have sheet 27 and layer of paper fiber 35 integrated by thermo-curing the thermosetting resins existing in mixed state. Diaphragm 304 as shown in FIGS. 18 and 19 is thus produced.

As described in the above, in a manufacturing method in accordance with the third embodiment, open gap is seldom observed at the interface between paper board 306 and woven cloth 305. Thus, a sufficient bonding strength is ensured between paper board 306 and woven cloth 305, and the risk of trouble with diaphragm can be reduced.

Diaphragm 304 manufactured in accordance with the third embodiment of the present invention exhibits a sufficiently high bonding strength between paper board 306 and woven cloth 305. Speakers which include the diaphragm have lower risk of peel-off troubles. This seems to be advantageous for improving the quality level of speakers.

INDUSTRIAL APPLICABILITY

A speaker diaphragm in the present invention includes a woven cloth in which an impregnated thermosetting resin is in the thermo-cured state, and a paper board integrated with the woven cloth at the back surface by thermo compression bonding. The woven cloth has a weave texture exposed at the front surface. The strength of diaphragm is high because it is made with woven cloth, and the hardness is high because it has been enhanced by taking advantage of thermo-curing of the thermosetting resin. Thus the present invention offers a diaphragm which demonstrates superior vibration characteristics in high frequency sound region, also speakers which include the diaphragm. Such speakers would find broad application fields in various kinds of acoustic apparatus.

The invention claimed is:

1. A speaker diaphragm comprising:

a woven cloth impregnated with a thermosetting resin, in which the thermosetting resin is in a thermo-cured state, and a paper board bonded to be integrated with the woven cloth at a back surface of the woven cloth; wherein the woven cloth has a weave texture exposed at a front surface which is opposite to that bonded with the paper board, and the paper board is impregnated with the thermosetting resin at both a) a side facing the woven cloth and b) an opposite side to the side facing the woven cloth.

2. The speaker diaphragm of claim 1, wherein the paper board is impregnated inside with the thermosetting resin.

3. The speaker diaphragm of claim 1, wherein the thermosetting resin impregnated in the woven cloth and the paper board have an identical property.

4. A method of manufacturing a speaker diaphragm on a manufacturing unit which includes a first metal mold and a second metal mold disposed opposed to be clamped with the first metal mold, comprising the steps of:

impregnating a paper board with a thermosetting resin at both a first side and a second side opposite the first side;

positioning a woven cloth impregnated with the thermosetting resin adjacent the second side of the paper board, the woven cloth having a weave texture exposed at a surface opposite to that facing the paper board; and clamping the first and second metal molds to compress the paper board and the woven cloth so the paper board and the woven cloth are bonded together through thermo compression and the thermosetting resin is in a thermo-cured state.

5. The method of manufacturing a speaker diaphragm recited in claim 4, wherein the paper board is immersed in the thermosetting resin during the step of impregnating.

6. The method of manufacturing a speaker diaphragm recited in claim 4, wherein the paper board is applied with the thermosetting resin by painting or spraying it on the first and second sides during the step of impregnating.

7. A speaker diaphragm comprising a woven cloth impregnated with a thermosetting resin, in which the thermosetting resin is in a thermo-cured state, and a paper board bonded to be integrated with the woven cloth at a back surface of the woven cloth; wherein the woven cloth has a weave texture exposed at a front surface which is opposite to that bonded with the paper board, and the paper board has a mixed layer of the thermosetting resin and paper fiber at a side facing the woven cloth.

8. The speaker diaphragm of claim 7, wherein the thermosetting resin impregnated in the woven cloth and in the paper board have an identical property.

9. A method of manufacturing a speaker diaphragm on a manufacturing unit which includes a first metal mold and a second metal mold disposed opposed to be clamped with the first metal mold, comprising the steps of:

impregnating a paper board with a thermosetting resin at a surface such that the paper board includes a mixed layer of the thermosetting resin and paper fiber; and positioning a woven cloth impregnated with the thermosetting resin adjacent the surface of the paper board including the mixed layer, the woven cloth having a weave texture exposed at a surface opposite to that facing the paper board; and clamping the first and second metal molds for compressing the paper board and the woven cloth which has been impregnated with the thermosetting resin so the paper board and the woven cloth are bonded together by thermo compression and the thermosetting resin is in a thermo-cured state.

10. The method of manufacturing a speaker diaphragm recited in claim 9, wherein the paper board is impregnated with the thermosetting resin by painting it during the step of impregnating.

11. The method of manufacturing a speaker diaphragm recited in claim 9, wherein the paper board is impregnated with the thermosetting resin by spraying it during the step of impregnating.

12. A speaker diaphragm recited in claim 1, wherein the woven cloth contains at least one fiber among the group of aramid fiber, polyester fiber, acrylic fiber, cotton fiber, carbon fiber, glass fiber and silk fiber.

13. A speaker diaphragm recited in claim 1, wherein the thermosetting resin is a resin which contains at least one among the group of phenol resin, acrylic resin, epoxy resin and vinyl ester resin.

14. A speaker diaphragm recited in claim 7, wherein the woven cloth contains at least one fiber among the group of aramid fiber, polyester fiber, acrylic fiber, cotton fiber, carbon fiber, glass fiber and silk fiber.

15. A speaker diaphragm recited in claim 7, wherein the thermosetting resin is a resin which contains at least one among the group of phenol resin, acrylic resin, epoxy resin and vinyl ester resin.

* * * * *